US007378919B2

(12) United States Patent
Zimmerling

(10) Patent No.: US 7,378,919 B2
(45) Date of Patent: May 27, 2008

(54) PLANAR MICROWAVE LINE HAVING MICROSTRIP CONDUCTORS WITH A DIRECTIONAL CHANGE REGION INCLUDING A GAP HAVING PERIODIC FOLDINGS

(75) Inventor: Detlef Zimmerling, Eberstadt (DE)

(73) Assignee: Atmel Germany GmbH, Heilbronn (DE)

( * ) Notice: Subject to any disclaimer, the term of this patent is extended or adjusted under 35 U.S.C. 154(b) by 48 days.

(21) Appl. No.: 11/260,124

(22) Filed: Oct. 28, 2005

(65) Prior Publication Data

US 2006/0091973 A1 May 4, 2006

(30) Foreign Application Priority Data

Oct. 29, 2004 (DE) ..... 10 2004 053 517
Aug. 3, 2005 (DE) ..... 10 2005 038 456

(51) Int. Cl.
*H01P 3/08* (2006.01)

(52) U.S. Cl. ..... 333/1; 333/246

(58) Field of Classification Search ..... 333/1, 333/116, 238, 246
See application file for complete search history.

(56) References Cited

U.S. PATENT DOCUMENTS 4,383,227 A 5/1983 de Ronde
5,625,169 A * 4/1997 Tanaka ..... 174/250
5,818,308 A * 10/1998 Tanaka et al. ..... 333/116
6,347,041 B1 * 2/2002 Hailey et al. ..... 361/777

FOREIGN PATENT DOCUMENTS

DE 29 43 502 C2 5/1980

* cited by examiner

*Primary Examiner*—Benny Lee
(74) *Attorney, Agent, or Firm*—Muncy, Geissler, Olds & Lowe, PLLC

(57) ABSTRACT

A planar microwave line is provided, having a dielectric substrate and a planar arrangement of a first microstrip conductor and at least one additional microstrip conductor, in which a gap between the first microstrip conductor and the additional microstrip conductor permits an electromagnetic coupling, a first region in which the microwave line has a first direction, a second region in which the microwave line has a second direction, and a transition region in which a change from the first direction to the second direction occurs. The microwave line is characterized in that the adjacent edges of the first microstrip conductor and of the additional microstrip conductor in the transition region are equal in length and do not cross.

10 Claims, 2 Drawing Sheets

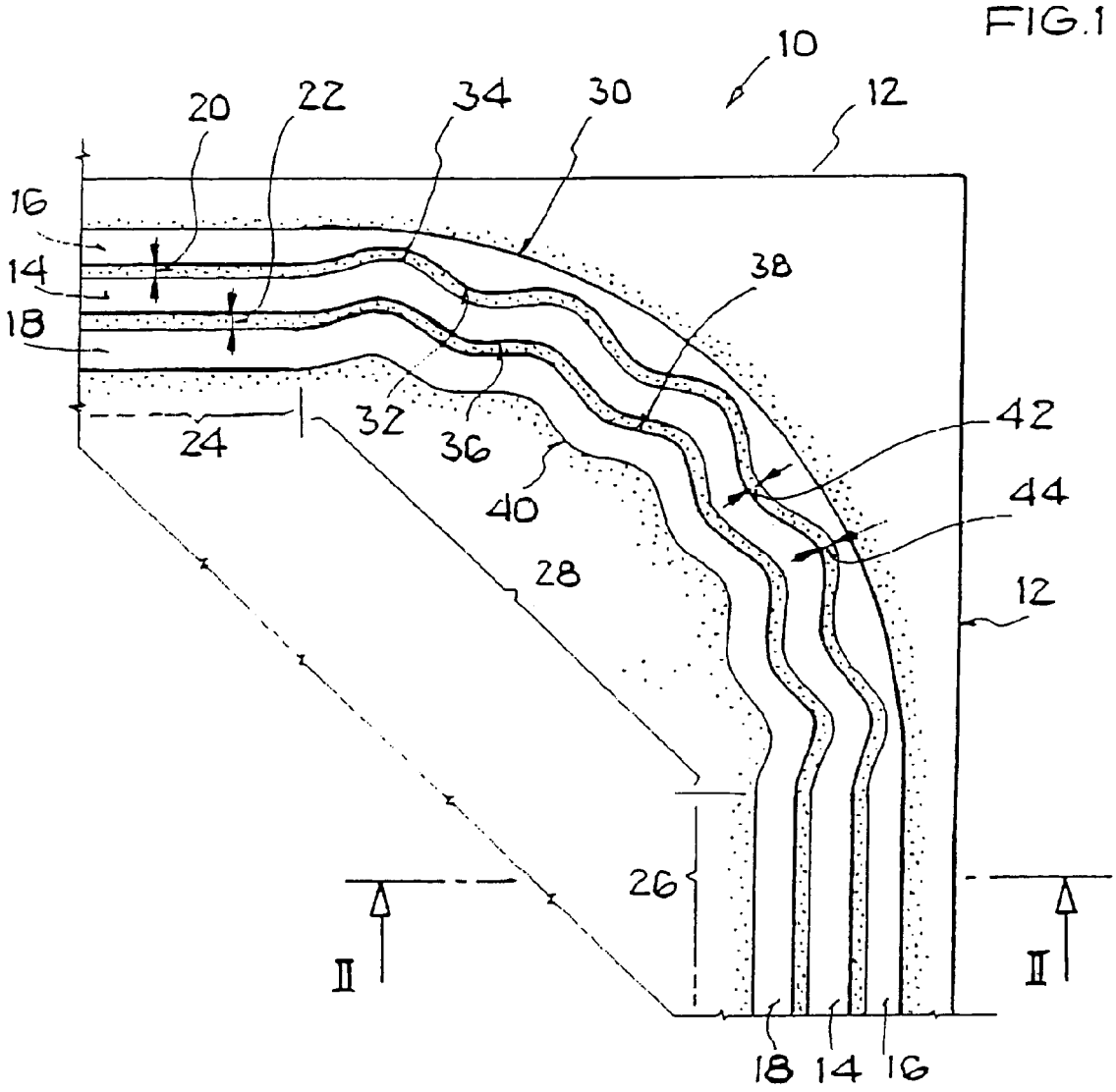
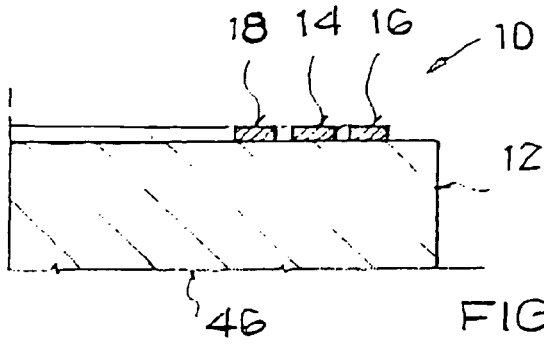
FIG.2

PLANAR MICROWAVE LINE HAVING MICROSTRIP CONDUCTORS WITH A DIRECTIONAL CHANGE REGION INCLUDING A GAP HAVING PERIODIC FOLDINGS

This nonprovisional application claims priority under 35 U.S.C. § 119(a) on German Patent Application Nos. DE 10200538456.0 and DE 102004053517.5, which were filed in Germany on Aug. 3, 2005 and Oct. 29, 2004, respectively, and which are herein incorporated by reference.

BACKGROUND OF THE INVENTION

1. Field of the Invention

The present invention relates to a planar microwave line having a dielectric substrate and a planar arrangement of a first microstrip conductor and at least one additional microstrip conductor, in which a gap between the first microstrip conductor and the additional microstrip conductor permits an electromagnetic coupling, to a first region in which the microwave line has a first direction, to a second region, in which the microwave line has a second direction, and to a transition region in which a change from the first direction to the second direction occurs. The invention relates further to a method for guiding a microwave, which propagates in this type of microwave line.

2. Description of the Background Art

This type of microwave line is known from DE 29 43 502, which corresponds to U.S. Pat. No. 4,383,227. This publication relates to suspended microstrip lines, which are therein understood to be a joining of two parallel metal surfaces, a dielectric substrate placed parallel to and between the surfaces, and a first strip-shaped conductor placed on a first surface of the substrate. According to DE 29 43 502, a second strip-shaped conductor is to be placed on the surface of the substrate, the conductor which runs primarily parallel to the first conductor and can be coupled to the conductor electromagnetically. For a curve in the line, this publication stipulates interrupting the first and the second conductor by a slot in a direction of a bisector of the deflection angle and connecting the first and the second conductors crosswise. This should keep the length of both lines equal along the curve. The crosswise connection occurs with the aid of a first connection running within the conductor plane and with the aid of a second connection, which runs outside the conductor plane and is realized in the form of a conducting jumper.

It is also known that discontinuities in the signal path such as open ends, feed-throughs through the dielectric, wave resistance jumps, crossing of lines, or directional changes, for example, breaks in the path of lines, produce distortions in the electromagnetic fields, which corrupts transmitted signals.

For example, coplanar microwave lines without an associated ground plane on a substrate side, which is opposite to the substrate side with the planar microstrip lines, with straight routing exhibit very good high-frequency properties. With directional changes, as occur, for example, in a routing in arcs, on the contrary, undesirable signal corruptions and shifts in the electrical ground-zero point occur.

The prior-art microwave line with the interruptions and the conducting jumper extending from the plane into the third dimension also exhibits discontinuities and thereby undesirable wave resistance increases.

SUMMARY OF THE INVENTION

It is therefore an object of the present invention to provide a planar microwave line exhibiting directional changes and having minimized corruptions of transmitted signals.

This object is achieved in a microwave line having adjacent edges of a first microstrip conductor and of an additional microstrip conductor in a transition region being equal in length and the first microstrip conductor and the second microstrip conductor in the transition region running without crossing.

Further, this object is achieved in a method of the aforementioned type by guiding the microwaves in the transition region without crossing along adjacent edges of equal length of the first microstrip conductor and of the additional microstrip conductor.

In so doing, the invention is based on the fact that both different propagation times of signals on coupled microstrip conductors and discontinuities in the line path are avoided. If a microwave line with microstrip conductors running initially parallel in the first direction experiences a bend in a two-dimensional transition region to a second direction, without any countermeasures, a difference between the lengths of the outer microstrip conductor and the inner microstrip conductor arises initially, because the arc lengths of the different curvature radii are different. This results in different signal propagation times between the two coupled microstrip conductors, which together transmit the propagating signal.

The cause of signal corruptions, which result from different signal path lengths in the two-dimensional transition region from a first direction to a second direction, is eliminated by the equal lengths of the coupled microstrip conductors as taught by the invention in the transition region. Discontinuities are avoided, for example, by the microstrip conductor path, which runs further in a plane without crossing in the transition region as well.

Because of the elimination of these causes of signal corruptions, costly analyses of branching and connection of compensating dummy elements are not necessary. The invention thereby provides a planar microwave line, whose good high-frequency properties are largely retained with a curved routing as well.

The microwave line can have a second microstrip conductor and a third microstrip conductor as additional microstrip conductors.

This embodiment provides a coplanar line that can be used as a more cost-effective replacement for a coaxial line. A particular advantage of the invention is that it can also be used in such coplanar lines. During application of the subject of DE 29 43 502 to a coplanar line, on the contrary, a transposition of signal conductors and screening conductors would occur, which would interfere with the screening functionality of the coplanar line. It is also preferred that the gap between the first microstrip conductor and each additional microstrip conductor in the first region and in the second region is constant in each case and in the transition region has a periodic modulation around an average value, which corresponds to the gap in the first region and/or in the second region.

In addition to length uniformity, extensive constancy of the microwave line wave impedance, which depends on the gap of the microstrip conductor, is further achieved by the invention. Sections with a larger gap and thereby greater wave impedance and sections with a smaller gap and thereby lower wave impedance counterbalance in the ideal case.

Furthermore, a periodic modulation of the gap occurs as the result of a periodic folding of at least one inner edge, which has a certain wavelength.

An inner edge can be lengthened as desired by such periodic folding and thereby matched to the length of another outer edge of an adjacent microstrip conductor with a higher curvature radius.

It is also preferable that the periodic modulation of the gap arises due to folding of opposite edges of adjacent microstrip lines having different wavelengths.

By this embodiment, convexities in the paths of the edges can largely approach the ideal of a parallel path, so that deviations in the gap between both edges from an average value are very low.

It is also preferable that a number of folding periods, therefore a number of wavelengths, on an inner edge of the microwave line is equal to a number of folding periods on any other inner edge of the microwave line.

This embodiment results in minimal gap deviations from an average gap also in microwave lines with more than two coupled microstrip lines.

Furthermore, the lengths of all edges of all microstrip lines in a transition region can be equal. Alternatively, at least the lengths of the inner edges can be equal; in this case, the lengths of the outer edges may be different.

In microwave lines as well with more than two coupled microstrip lines, a corruption of transmitted signals caused by propagation time differences is thus avoided.

The folding amplitude can increase with shortening wavelengths.

The length of an edge with a lower curvature radius and a preset number of folding periods can be matched by increasing the folding amplitude as closely as desired to the length of an adjacent edge with a greater curvature radius and the same number of folding periods.

The shortest wavelength of a folding of an edge of the microwave line can be longer than the wavelength of a highest useful signal frequency transmitted over the microwave line.

In general, interactions such as diffraction phenomena between structures and waves occur when the geometric dimensions of the structures are within the magnitude of the wavelength. Because, within the scope of this embodiment, the shortest wavelength of the structure is smaller than the wavelength resulting from the highest (permitted) frequency of the transmitted useful signal, such undesirable interactions are avoided.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIG. 1 is a plan view of a planar microwave line on a dielectric substrate;

FIG. 2 is a cross section through the microwave line and the substrate of FIG. 1.

DETAILED DESCRIPTION OF THE INVENTION

Figure 3:
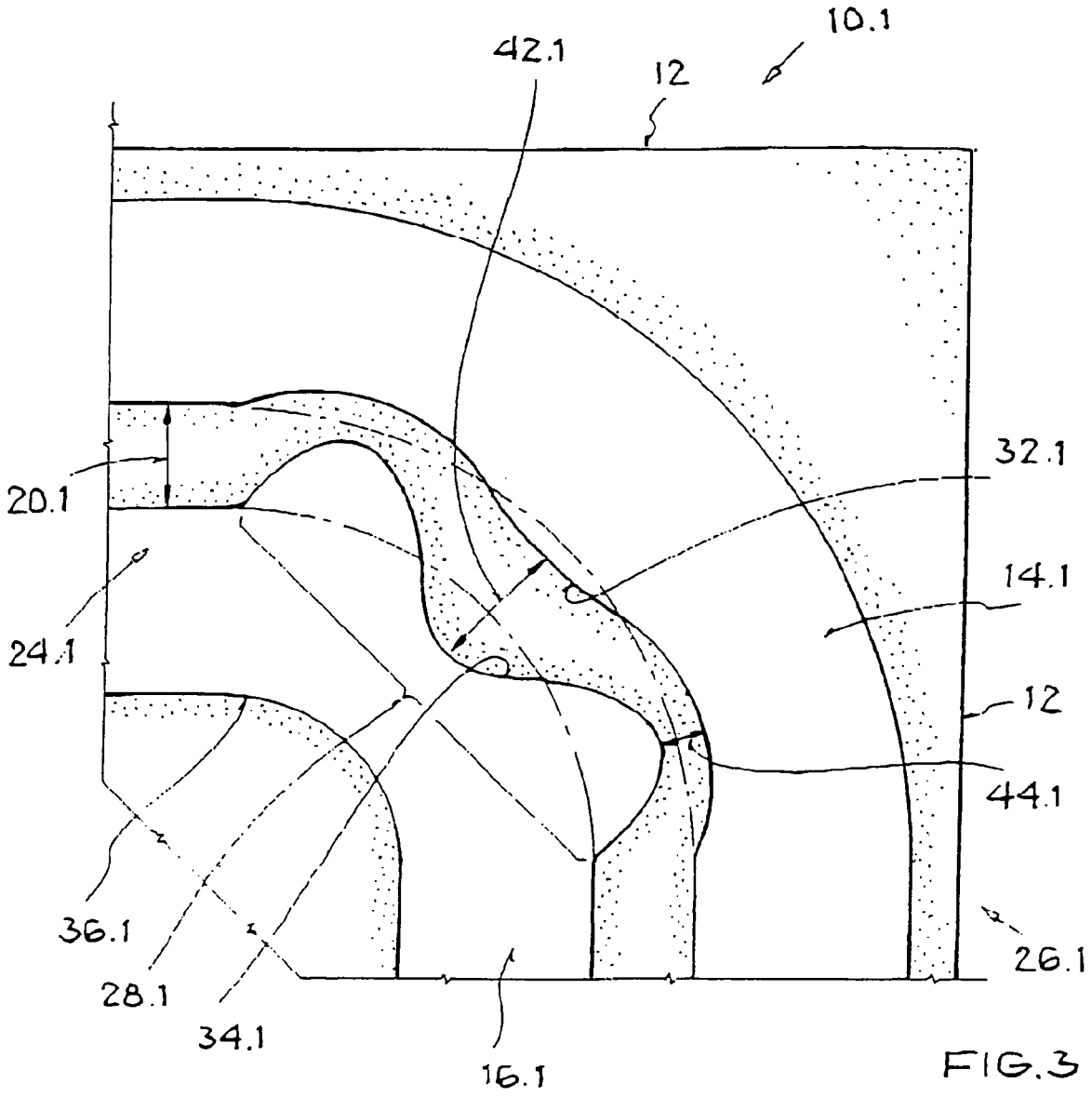
FIG. 3 illustrates another embodiment of a microstrip line of the invention having the features of the invention.

FIG. 1 shows a planar microwave line 10 in detail, which extends to a dielectric substrate 12 and has a first microstrip conductor 14 and two additional microstrip conductors 16 and 18. FIG. 1 thereby shows a coplanar line as microwave line 10. The coplanar line corresponds to a planar coaxial line. A first gap 20 between the first microstrip conductor 14 and a second microstrip conductor 16 as an additional microstrip conductor is dimensioned in such a way that during the transmission of microwaves an electromagnetic coupling occurs between the first microstrip conductor 14 and the second microstrip conductor 16. Analogously, a second gap 22 between the first microstrip conductor 14 and a third microstrip conductor 18 as an additional microstrip conductor is dimensioned in such a way that during the transmission of microwaves, an electromagnetic coupling occurs between the first microstrip conductor 14 and the third microstrip conductor 18.

The first microstrip conductor 14 corresponds to the inner conductor of a coaxial line and the additional microstrip conductors 16 and 18 are comparable to the outer conductor (shield) of a coaxial line. The width of the first microstrip conductor 14, gaps 20 and 22, and the dielectric constant of dielectric substrate 12 substantially determine the wave impedance Z of microwave line 10. This type of coplanar microwave line 10 possesses very good high-frequency properties as long as it can be laid out straight. In FIG. 1, microwave line 10 is laid out straight in a first region 24 in a first direction and in a second region 26 in a second direction. The change in direction from the first direction to the second direction and vice versa occurs in a transition region 28, in which microstrip conductors 14, 16, and 18 of microwave line 10 are laid out curved. Therefore, edges 30, 32, 34, 36, 38, and 40 as well of the three microstrip conductors 14, 16, and 18 are bent in the transition region 28.

In this regard, microwave line 10 of FIG. 1 has the distinct feature that of the edges 30, 32, 34, 36, 38, and 40, at least adjacent edges 34 and 32, as well as 36 and 38, of the first microstrip conductor 14 and second microstrip conductor 16, as well as of the first microstrip conductor 14 and third microstrip conductor 18, in the transition region 28 are equal in length and do not cross. This embodiment of the length of edges 34, 32 and 36, 38 is based on the realization that during transport of high-frequency signals over the microwave line 10, the highest field strengths occur at inner edges 32, 34, 36, and 38 of microstrip conductors 14, 16, and 18. Because the lengths of edges 34, 32, 36, and 38 are equal to each other, no propagation time differences occur in the signals running along edges 34, 32, 36, and 38. The equal length of edges 34, 32, 36, and 38 is achieved in the embodiment according to FIG. 1 in that the gap between the microstrip conductor 14 and second microstrip conductor 16 and/or between the second microstrip conductor 16 and third microstrip conductor 18 has a periodic modulation around an average value. The average value corresponds to gap 20 and/or gap 22 of microstrip conductors 14 and 16, or 14 and 18, in first region 24 and/or in second region 26. By means of the modulation, an inner edge, e.g., edge 34, is brought periodically closer to an outer edge, e.g., edge 32, and led away from the outer edge. In comparison with a purely parallel path of edges 34 and 32, inner edge 32 is lengthened by the periodic approaching and distancing, which in the ideal case compensates for its shortening due to the smaller curvature radius. This also applies to a lengthening of edge 40 to match the length of edge 36. In addition, the length of edge 36 is matched to the length of edge 34, so that edges 34, 32, 36, and 38 are equal in the subject of FIG. 1. As already indicated, in this case, the averages for the gap maxima and gap minima in transition region 28 correspond to the associated constant gap in the first region 24 and/or second region 26.

For the purpose of illustration, FIG. 1 shows gap maxima 42 and gap minima 44, which lie within transition region 28 and whose averages correspond to gap 20 of the first region 24. As already mentioned, an embodiment of the invention can also provide that the lengths of all edges 30, 32, 34, 36, 38, and 40 are equal to each other or the lengths of edges 32, . . . , 40 are matched to the length of edge 30, which is the longest because of its curvature radius. In so doing, the adjustment can be made by a sine-like folding of inner edges 32, . . . , 40, in which each inner edge 32, . . . , 40 carries the same number of waves. As a result, the wavelength becomes the shorter, the more inside an edge is located. The fact that the length of every edge corresponds to the length of another edge is evident from the fact that the folding amplitude increases with shortening wavelengths. In other words: the amplitude of the innermost edge 40 is greater than the amplitude of edge 38, which in turn is greater than the amplitude of inner edge 36, etc. For the purpose of illustration, FIG. 2 shows a cross section through dielectric substrate 12 and microwave line 10, lying thereupon, with microstrip lines 18, 14, and 16. FIG. 2 thereby shows in particular a cross section through a coplanar line without an associated ground on a side 46, facing microwave line 10, of substrate 12.

FIG. 3 shows an alternative planar microwave line 10.1, which has only a first microstrip conductor 14.1 and an additional microstrip conductor 16.1. Here as well, a second gap 20.1 between the first microstrip conductor 14.1 and the second microstrip conductor 16.1 as an additional microstrip conductor is dimensioned in such a way that during the transmission of microwaves, an electromagnetic coupling occurs between the first microstrip conductor 14.1 and the second microstrip conductor 16.1.

The width of the two microstrip conductors 14.1 and 16.1, their gap 20.1, and the dielectric constant of dielectric substrate 12, bearing microstrip conductors 14.1, 16.1, substantially determine the wave impedance Z of microwave line 10.1. In FIG. 3, microwave line 10.1 is laid out straight in a first direction in a first region 24.1 and in a second direction in a second region 26.1. The change in direction from the first direction to the second direction and vice versa occurs in transition region 28.1, in which microstrip conductors 14.1 and 16.1 of microwave line 10.1 are laid out curved.

In the embodiment of FIG. 3 as well, at least adjacent edges 34.1 and 32.1 of the first microstrip conductor 14.1 and the second microstrip conductor 16.1 in the transition region 28.1 are equal in length in combination with having a non-crossing path. The equal length of edges 34.1 and 32.1 is also achieved in the embodiment according to FIG. 1 in that the gap between the first microstrip conductor 14.1 and the second microstrip conductor 16.1 has a periodic modulation around an average value. The average value corresponds to gap 20.1 of microstrip conductors 14.1 and 16.1 in first region 24.1 and/or in second region 26.1. By means of the modulation, edge 34.1 is brought periodically closer to edge 32.1 and led away from this edge. In comparison with a parallel path of edges 34.1 and 32.1, edge 34.1 is lengthened relatively more greatly by the periodic approaching and distancing, which in the ideal case compensates for its relative shortening versus edge 32.1 due to the smaller curvature radius.

In this case, the averages for the gap maxima 42.1 and gap minima 44.1 in the transition region 28.1 correspond to the associated constant gap 20.1 in the first region 24.1 and/or second region 26.1. The periodic modulation thereby corresponds substantially to the comparable periodic modulation in FIG. 1, but is more clearly evident in the subject of FIG. 3.

The matching of the lengths of inner edges 34.1, 32.1 can again be achieved by a sine-like folding of inner edges 34.1, 32.1, in which each inner edge 34.1, 32.1 carries the same number of waves. In the embodiment in FIG. 3, these are three half-waves in each case. As a result, the wavelength becomes shorter, the more inside an edge is located. The fact that the length of edge 32.1 corresponds to the length of edge 34.1 is evident from the fact that the folding amplitude increases with shortening wavelengths. In other words: the amplitude of inner edge 34.1 is greater than the amplitude of edge 32.1. In the embodiment of FIG. 3, the amplitudes differ by about a factor of 3. The outer edges 30.1 and 36.1 in the embodiment of FIG. 3 to some extent possess their natural arc lengths; they therefore have different lengths. In most cases, this is not problematic, because the high-frequency signals propagate along the coupled inner edges 32.1 and 34.1. It is understood that these modifications can also be used in the coplanar embodiment of FIG. 1.

The equal length of inner edges 34.1, 32.1 or the edges in FIG. 1 can be achieved not only by means of a sine-like folding but also by other types of folding. An example of a different type of folding, for example, is the use of sections of straight lines, parabola curves, or generally arcs or sections of polynomials.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A planar microwave line comprising:

a dielectric substrate;

a planar arrangement of a first microstrip conductor and at least one additional microstrip conductor, in which a gap between the first microstrip conductor and the at least one additional microstrip conductor facilitates an electromagnetic coupling;

a first region in which the microwave line has a first direction;

a second region in which the microwave line has a second direction; and a transition region in which a change from the first direction to the second direction occurs, wherein a gap between adjacent edges of the first microstrip conductor and the additional microstrip conductor substantially and continuously varies in the transition region such that the adjacent edges of the first microstrip conductor and of the at least one additional microstrip conductor in the transition region are equal in length and such that the gap in the transition region periodically modulates around an average value, which corresponds to a gap in the first region and/or in the second region; and wherein the first microstrip conductor and the at least one additional microstrip conductor in the transition region run without crossing one another.

2. The microwave line according to claim 1, wherein the at least one additional microstrip conductor comprises a second microstrip conductor and a third microstrip conductor.

3. The microwave line according to claim 1, wherein a gap between the first microstrip conductor and each additional microstrip conductor in the first region and in the second region is constant.

4. The microwave line according to claim 1, wherein the periodic modulation of the gap in the transition region comprises periodic foldings of an inner edges of the first microstrip conductor and the at least one additional microstrip conductor and which has a certain wavelength.

5. The microwave line according to claim 4, wherein the periodic modulation of the gap further comprises a folding of opposite edges of adjacent microstrip conductors having different wavelengths.

6. The microwave line according to claim 4, wherein a number of the periodic foldings on an inner edge of the first microstrip conductor is equal to a number of the periodic foldings on any other inner edge of the at least one additional microstrip conductor.

7. The microwave line according to claim 6, wherein a shortest wavelength of the periodic foldings of the inner edges of the first microstrip conductor and the at least one additional microstrip conductor is longer than a wavelength of a highest useful signal frequency transmitted over the microwave line.

8. The microwave line according to claim 6, wherein an amplitude of the periodic foldings increases with shortening wavelengths.

9. The microwave line according to claim 1, wherein lengths of all edges of the first microstrip conductor and the at least one additional microstrip conductor in the transition region are equal to each other.

10. A method for guiding a microwave, the method comprising the steps of:

providing a planar microwave line in which the microwave propagates, the planar microwave line including a dielectric substrate and a planar arrangement of a first microstrip conductor and at least one additional microstrip conductors;

providing a gap between adjacent edges of the first microstrip conductor and the additional microstrip conductor thereby permitting an electromagnetic coupling, the microwave line further including a first region in which the microwave line has a first direction, a second region in which the microwave line has a second direction, and a transition region in which a change from the first direction to the second direction occurs; and guiding the microwaves in the transition region without crossing adjacent edges of equal lengths of the first microstrip conductor and of the additional microstrip conductor, wherein the gap provided between adjacent edges of the first microstrip conductor and the at least one additional microstrip conductor substantially and continuously varies in the transition region, and wherein the gap in the transition region periodically modulates around an average value, which corresponds to a gap in the first region and/or in the second region.

* * * * *